United States Patent [19]

Hendrix et al.

[11] Patent Number: 4,530,874

[45] Date of Patent: Jul. 23, 1985

[54] CHINTZ FABRIC AND METHOD OF PRODUCING SAME

[75] Inventors: James E. Hendrix, Spartanburg, S.C.; John Y. Daniels, Pineville; Bobby D. Jackson, Marshville, both of N.C.

[73] Assignee: Springs Industries, Inc., Fort Mill, S.C.

[21] Appl. No.: 523,034

[22] Filed: Aug. 12, 1983

[51] Int. Cl.[3] ..... B32B 7/00

[52] U.S. Cl. ..... 428/266; 427/258; 427/288; 427/366; 427/387; 427/389.9; 427/412; 428/446; 428/447

[58] Field of Search ..... 428/266, 274, 446, 447, 428/264, 452; 427/288, 258, 366, 389.9, 387, 412

[56] References Cited

U.S. PATENT DOCUMENTS

| | | | |
|---|---|---|---|
| 2,454,391 | 9/1944 | Jones et al. | 427/366 |
| 2,950,502 | 8/1960 | Weaver | 427/366 |
| 3,202,532 | 8/1965 | Labombarde | 427/366 |
| 4,423,108 | 12/1983 | Kalinowski et al. | 428/266 |

*Primary Examiner*—James J. Bell

*Attorney, Agent, or Firm*—Bell, Seltzer, Park & Gibson

[57] ABSTRACT

Chintz fabrics characterized by exhibiting a glossy smooth appearance and having enhanced hand, drapability and durability are produced by applying to the fabric a finishing composition comprising a silicone polymer and a catalyst, drying the impregnated fabric to a suitable moisture content without curing the finishing agent, and calendering the fabric with a heated calender roll to form a smooth glossy surface on the fabric while curing the finishing composition.

31 Claims, 4 Drawing Figures

CHINTZ FABRIC AND METHOD OF PRODUCING SAME

FIELD OF THE INVENTION

This invention relates to a textile fabric having a glossy chintz finish with improved appearance, hand, drapability and durability, and to a method of producing the same.

BACKGROUND OF THE INVENTION

A chintz finish is obtained on a textile fabric by a glazing process wherein the fabric is subjected to the action of a hot polishing roll, such as a calender, to impart a shiny surface to the fabric. Originally, chintz finishes were achieved by polishing a fabric which had been treated with starch and wax glazes. However, these finishes were not durable, and were removed by laundering. Later technology involved the use of resin glazes which could be cured on the fabric and which would thereby provide some degree of permanence to the chintz finish. Still, after a half dozen or more launderings, the characteristic sheen of the chintz is lost.

The calendering or polishing operation which has been used heretofore to provide the chintz finish has presented particular difficulties when applied to printed fabrics. During the calendering operation, the pigment applied to the fabric tends to pick off the fabric, contaminating the polishing roll, and then being transferred from the roll back onto the fabric, resulting in a smeared appearance to the printed area which renders the fabric either as second quality or totally unusable.

Additionally, printed chintz fabrics produced by conventional processes known heretofore have tended to be relatively stiff, especially where relatively large size printed pattern areas are involved. While the fabrics have been widely used in drapery and upholstery applications, they have found limited usefulness as apparel fabrics where a more soft and supple fabric is usually desired.

With the foregoing in mind, it is an object of the present invention to provide an improved chintz fabric and method of production which overcomes the aforementioned limitations and disadvantages.

More specifically, it is an important object of this invention to provide a chintz fabric having improved durability to laundering and dry cleaning.

It is a further object of this invention to provide a chintz fabric with an enhanced, luxuriously soft, satiny hand and excellent drapability properties which make the fabric particularly well suited to use in a variety of applications, including wearing apparel.

Still another object of this invention is to provide a process for producing chintz effects on printed fabrics which alleviates quality problems caused by transfer of pigment on the hot calender roll.

SUMMARY OF THE INVENTION

These, as well as additional objects and advantages are achieved in accordance with the present invention with the use of a silicone-containing finishing composition which is cured on the fabric during hot calendering in the manner described more fully herein.

More particularly, in accordance with the fabric finishing process of the present invention, a curable finishing composition containing a silicone polymer is applied to the fabric and dried to a suitable moisture content, but without curing the finishing composition. The fabric is then subjected to a heated calender roll which serves to polish the fabric and impart the desired glossy chintz finish while simultaneously causing the silicone polymer to react and cure. The cured silicone polymer coating forms a thin film at the surface of the fabric and encapsulates the fibers present at the surface of the yarns while also penetrating into the yarns to durably retain the cured silicone polymer coating on the fabric. The thin film of cured silicone polymer also serves to at least partially fill the interstices between the yarns of the fabric and to form a smooth overall surface to the fabric imparting a glossy chintz appearance thereto. The calendering of the fabric with the heated calender roll is performed with sufficient pressure to effect flattening of the yarns which form the fabric, and the curing of the finishing composition during calendering serves to retain the yarns in the flattened condition, thereby contributing to the durability of the glossy chintz finish. The hot calendering operation is desirably followed by further heating to ensure complete curing of the finishing composition.

The silicone polymers used in the finishing composition of the present invention are water soluble or water dispersible film-forming silicone polymers. When heated in the presence of a suitable catalyst during the calendering operation, these polymers will react and crosslink to form a cured coating which is highly durable to laundering and dry cleaning. The finishing composition may also contain, in addition to the silicone polymer and catalyst, a cross-linking agent. Under the heat and pressure of calendering, the cross-linking agent also reacts and cross-links, further contributing to the durability of the chintz-like sheen and also providing excellent crease recovery to the fabric. The silicone polymer acts as a lubricant both for the heated calender roll and for the fabric surface to protect against transfer of printing pigment to the heated calender roll and to provide an enhanced sheen to the fabric surface. The heat provided by the heated calender roll causes the silicone polymer to react and cure to durably retain the silicone finishing composition and the sheen imparted thereby.

The chintz finishing process of this invention is suitable for undyed or dyed fabrics, including both prints and solid colors. The fabric may be formed from synthetic fibers, from natural fibers such as cotton, or from blends of synthetic and natural fibers. Printed chintz fabrics produced in accordance with the present invention are characterized by having a glossy smooth appearance with enhanced hand and drapability. The fabric has printed areas at predetermined locations thereof, with the printed areas comprising a binder and at least one colorant of a predetermined color adhered to the yarns by the binder. A cured coating of a silicone-containing finishing composition overlies the surface of the fabric and the printed areas thereon, forming a film around the fibers present at the surface of the fabric and imparting a glossy smooth chintz appearance to the surface of the fabric, together with enhanced fabric hand and drapability.

BRIEF DESCRIPTION OF THE DRAWING

Some of the features and advantages of this invention having been described, others will become apparent from the detailed description which follows and from the accompanying drawing and illustrative examples. It is to be understood, however, that the drawing, detailed description and examples which follow are for the purpose of illustrating and more completely describing the present invention and how it may be practiced, and are not intended to be understood as being restrictive upon the scope of the present invention. Persons skilled in the arts applicable to the present invention will be enabled by this disclosure to produce products and practice methods which embody the present invention and yet take forms which may differ from those here particularly shown and described.

DETAILED DESCRIPTION

The present invention is applicable to fabrics of various different constructions and fiber compositions, and especially to fabrics woven from yarns formed of natural fibers, synthetic fibers, or blends of natural and synthetic fibers. The invention is particularly applicable to fabrics formed at least partially of cellulosic fibers, such as cotton or rayon. The fabrics may be in an undyed state or dyed a uniform color throughout by any suitable method, such as piece dyeing. The fabrics may also be printed with printed pattern areas of various colors, either in selected areas of the fabric or throughout the fabric.

Figure 1:
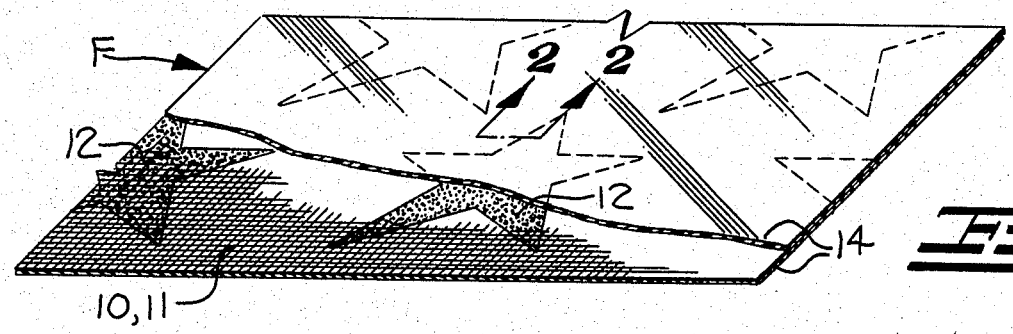
FIG. 1 is a schematic perspective view illustrating a textile fabric produced in accordance with the present invention.
Figure 2:
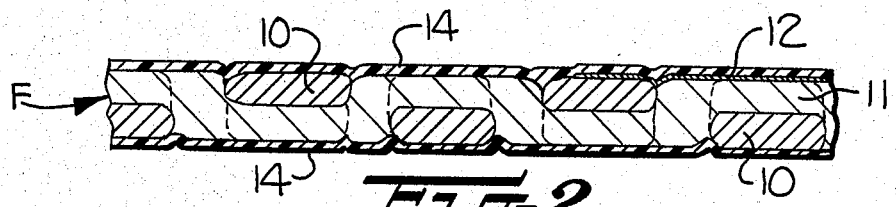
FIG. 2 is an enlarged, very schematic cross-sectional view of the fabric taken substantially along the line 2—2 of FIG. 1.

Referring now more particularly to the drawings, FIGS. 1 and 2 schematically illustrate a woven printed textile fabric having a chintz finish produced in accordance with the present invention. The fabric, generally indicated by the reference character F, is formed of interwoven warp and weft yarns 10, 11 respectively (FIG. 2). In certain locations on the fabric, printed areas 12 are provided.

The printed areas 12 on the fabric may be produced in any of a number of ways. For example, the printing may comprise conventional resin bonded pigments, which may be applied in any conventional manner, such as by rotary screen printing. In accordance with this known printing process, a printing paste containing a heat curable binder and one or more pigments of predetermined color is applied to the fabric, and the fabric is thereafter heated to dry the printing paste and cure the resin binders so that the pigments are bound to the fabric. In conventional resin bonded pigment printing, the printed areas are somewhat transparent and are unable to fully cover and hide the color of the underlying yarns. While the pigments serve to color the yarn in the printed areas, the underlying color of the yarn shows through and affects the overall color of the printed area. For this reason, conventional pigment printing is usually done on uncolored or white fabrics. When pigment printing is done on predyed fabrics, it is generally restricted to the printing of darker colors over a lighter background color. Even then, the effect of the background color on the pigment must be taken into account in order to obtain the desired resulting color. In order to produce fabrics with large areas of a relatively dark background color against lighter colored pattern areas, the relatively dark background areas are produced by printing. The large expanses of resin bonded pigment on the fabric causes the fabric to be relatively stiff and boardy. The large pigment printed areas also increase the problem of pigment pick off during the hot calendering operation utilized in chintz finishing. Thus the present invention is especially useful for use in connection with printed fabrics having printed areas formed from conventional resin-bonded pigment printing.

The present invention is also useful on fabrics which have been printed with pigmented solvent-based lacquer printing systems. In this printing technique, the pigmented lacquer, which is not unlike a paint, is applied to the fabric in a relatively thick layer with a special type of rotary stencil printing range utilizing a perforated roll. The resulting printed areas are thermoplastic and when heated by a hot calender roll, have a tendency to transfer to the roll. The present invention significantly reduces this problem of pigment transfer.

The printed areas may also be produced by the opaque pigment printing process described and claimed in commonly owned copending applications Ser. No. 429,794, filed Sept. 30, 1982 and Ser. No. 435,949 filed Oct. 22, 1982, the disclosures of which are hereby incorporated by reference. In accordance with the process described in these copending applications, printed areas are produced which are substantially opaque and are unaffected by the color of the underlying yarns. The printed pattern areas produced by this process comprise an opaque coating which covers the exposed surfaces of the yarns, with the coating comprising an opacifying pigment providing opacity in the coating, colorants, such as white or colored pigments, and a cured water insoluble binder affixed to the yarns and bonding the opacifying pigment to the yarns.

The curable finishing composition is applied to the printed fabric in a suitable manner, such as by roll application or padding, to thoroughly cover the surface of the fabric. Desirably, the fabric is thoroughly impregnated. The fabric is then dried, preferably to a moisture content of from about 1 to about 25%, most desirably from about 4 to about 8%, leaving the fabric in a condition suitable for hot calendering. It is important that the drying of the fabric be carried out under relatively gentle conditions which will avoid any significant degree of curing of the finishing composition. Preferably, the fabric temperature during the drying operation should not exceed about 300° F., and most desirably the fabric temperature during curing should be in the range of about 225° to 275° F. It has been found that when any significant degree of curing of the finishing agent takes place prior to calendering, the resulting chintz finish is not as permanent as when the resins are cured on the calender in the glazed condition. The drying operation may be suitably carried out on a tenter frame. A steam heated tenter frame has been found to be especially suited for providing the desired control over temperature to avoid curing and to leave the fabric at the desired moisture content.

Silicone compounds which may be used in the finishing composition of the present invention may be broadly characterized as water soluble or water dispersible film-forming silicone polymers, which when heated in the presence of a catalyst, will react and cure to form a permanent water-insoluble film coating on the fabric. Examples of such silicone polymers include dimethyl polysiloxanes, dimethyl diphenyl polysiloxanes, methyl hydrogen polysiloxanes, methyl alkyl polysiloxanes, phenyl trimethyl polysiloxanes, diphenyl polysiloxanes, silicon glycol copolymers, chlorophenyl methyl polysiloxanes, polydimethylsiloxane/polyethyleneoxide/-polypropyleneoxide copolymers, polydimethylsiloxane/polyoxyalkylene copolymers, fluorosilicone fluids, and silanol fluids. The silicone compounds may, if desired, have reactive functional groups such as carboxyls, hydroxyls, amine groups, esters, and mercaptans. Functional silicone compounds may provide improved durability to laundering and dry cleaning through increased crosslinking via the functional groups.

Examples of commercially available silicone compounds which may be suitably used in the finishing composition include the following:

Solusoft 100—Soluol Chemical Company; a 29% solids composition, of which 26% is methyl hydrogen polysiloxane and 3% polyethylene.

Solusoft 115—Soluol Chemical Company; a blend of silicone and polyethylene polymers.

Ultratex WK—Ciba Geigy; a durable silicone elastomer based upon silanol functionality, incorporating a hydrogen siloxane and metal salt catalysts.

General Electric 2061; a 35% solids emulsion of a polydimethyl siloxane fluid.

General Electric 2162; a 50% solids emulsion of a polydimethyl siloxane fluid.

The finishing composition also includes a curing catalyst which, at elevated temperature, is effective to cause the silicone compound to react and cure. Acid catalysts are preferred. Examples of suitable acid catalysts include magnesium chloride, zirconium oxychloride, antimony trichloride, sulfonic acids and ammonia capped sulfonic acids. The preferred class of acid catalysts for use with the present invention are Lewis acid catalysts, examples of which include aluminum halides, titanium tetrachloride, and alkyl titanates, such as butyl titanate.

In addition to the curable silicone polymer and catalyst, the finishing composition also preferably includes a cross-linking agent. Cross-linking agents suitable for use in the present invention are capable of reacting with and cross-linking cellulosic fibers under the conditions of heat and pressure to which the fabric is subjected on the calender roll. A preferred class of cross-linking agents comprises reactive compounds of the type conventionally used as durable press finishing agents. Examples of suitable cross-linking agents include aldehydes such as formaldehyde and glyoxal, carbamates, urons, unsaturated compounds such as diallyl esters and aminoplast resins. An aminoplast resin is made by the reaction of an amine, such as a urea or melamine compound, with an aldehyde, such as formaldehyde. Examples of aminoplast resins include ureaformaldehyde resins, dimethylolurea resins, dimethyl ether of ureaformaldehyde, melamine formaldehyde resins, cyclic ethylene ureaformaldehyde resins, cyclic propylene urea resins, and triazones. Especially suitable are linear or cyclic ethylene urea compounds such as dimethylol dihydroxy ethylene urea (DMDHEU), dimethylol ethylene urea (DMEU). The aminoplast resin cures and crosslinks under the heat and pressure of the calender roll, providing enhanced durability to the shiny chintz finish and also imparting crease recovery and durable press properties to the fabric.

The finishing composition may also contain other conventional additives such as added surfactants, wetting agents, emulsifying agents, etc.

Suitable finishing compositions for use in the invention may have a formulation as follows:

| | Percent by Weight | |
|---|---|---|
| | (broad) | (preferred) |
| aminoplast resin | 2–40 | 4–15 |
| acid catalyst | .1–10 | .5–5 |
| silicone compound | .1–25 | .5–5 |
| surfactant | up to 10 | up to .5 |
| water | balance | balance |

The finishing agent, when applied to the fabric and dried in the manner described, forms a film around the yarns and around the fibers of the yarns present at the surface of the fabric, which is subsequently cured during the calendering operation. The heated calender roll is desirably operated at a temperature of from about 175° to about 600° F. and at pressures of about 200 to about 3000 psi or higher. During the calendering operation, the high temperature and pressure applied by the calender roll, together with the moisture present in the yarns, promotes flattening of the yarns. The silicone polymers give added lubrication to reduce pickoff of pigments onto the calender roll, enhance the gloss of the fabric, and impart a very smooth, soft hand with excellent drapability. Excellent durability to laundering is achieved because the finishing composition is cured during the calendering operation. The resin serves to crosslink the fibers in this flattened state to assist in maintaining the smooth glossy surface.

Referring to FIGS. 1 and 2, the cured coating of silicone polymer is indicated by the reference character 14. It will be seen that the coating 14 forms a thin film at the surface of the fabric which encapsulates the fibers present at the surface of the yarns while also penetrating the yarns to durably retain the cured silicone polymer coating on the fabric. It will also be seen that the thin film of cured silicone polymer also serves to at least partially fill the interstices between the yarns of the fabric and to form a smooth overall surface to the fabric, giving it its glossy chintz appearance. The smooth, glossy chintz appearance is further accentuated in that the outermost portions of the yarns at the surface of the fabric have a flattened configuration as a result of the calendering. As seen in FIG. 2, the coating 14 overlies the printed areas 12.

It is believed that during curing on the calender roll, the polysiloxane chains are hydrolized and cleaved by the acid catalyst, resulting in polysiloxane segments with highly reactive radical sites. These reactive sites may then react with other polymer chains forming a network structure, or even with the cellulose molecule if cellulosic fibers such as cotton or rayon are present. If the silicone polymers are selected having specified functionality, such as hydroxyl, carboxyl, epoxy, amine groups etc., these reactive groups may also aid in crosslinking of the polysiloxane chains with each other, and with the cellulose, if present.

The examples which follow illustrate methods by which the present invention can be carried out.

EXAMPLE 1

Figure 3:
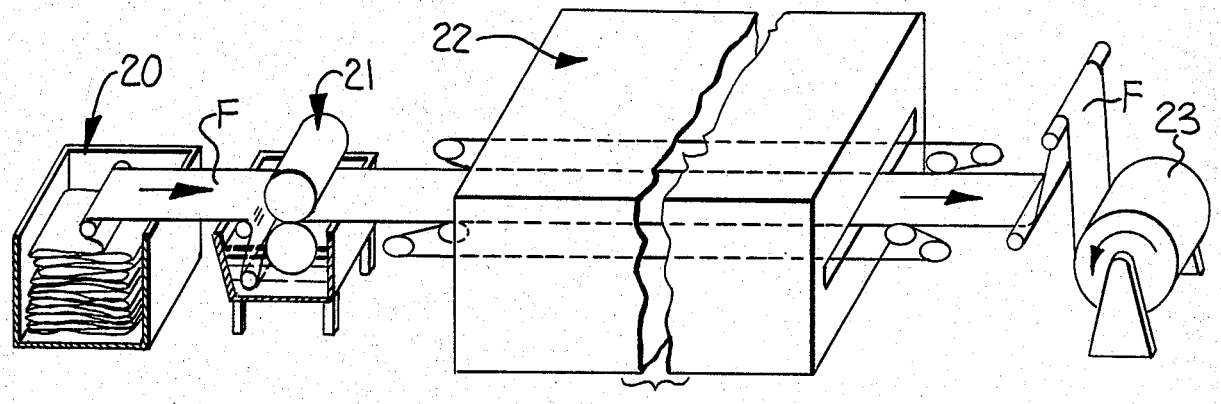
FIGS. 3 and 4 are schematic block diagrams illustrating an arrangement of apparatus suitable for carrying out the process of the present invention.
Figure 4:
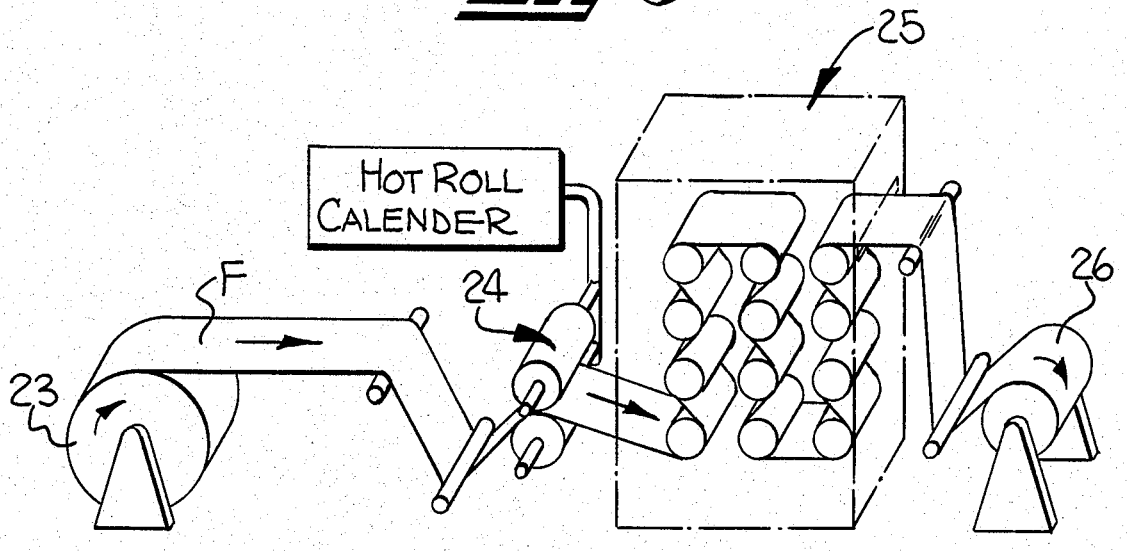

This example describes one suitable method for imparting a chintz finish, reference being made to FIGS. 3 and 4 of the accompanying drawings. A polyester/cotton blend woven fabric F printed with a conventional resin bonded pigment was directed from a supply source, such as the box 20 (FIG. 3), and through a pad 21 and impregnated with a finishing bath of the following composition:

DMDHEU resin—5%
Magnesium chloride catalyst—3%
Solusoft 115 (Polyethylene/silicone dispersion)—3%
Wetting agent—0.1%

A wet pickup of about 40 to 50% was achieved on the pad. The fabric F was then dried on a tenter frame 22 at 220° F. at a speed of approximately 90 yards/minute. Upon leaving the tenter, the fabric had a moisture content of about 6%. The fabric F was batched on a roll 23 at the exit end of the tenter frame 22. At this point in the process, the finish has been only dried, not cured.

The fabric F was then fed from the roll 23 to a Schreiner calender 24 (FIG. 4) having heated rolls operating at a temperature of 400° F. and with roll pressures on the order of 1900 psi. Upon leaving the calender 24, the fabric was directed into and through a roller curing oven 25 at a temperature of about 330° to about 350° F., which serves to ensure complete curing of the finish. The fabric was then taken up on a roll 26.

EXAMPLE 2

A 65/35 polyester/combed cotton black dyed fabric was printed with an opaque white printing formulation as follows, followed by drying and curing of the print formulation.

| Opaque Printing Formulation | Percent |
|---|---|
| Titanium dioxide dispersion | 63.5 |
| Aluminum silicate dispersion | 14.5 |
| Acrylic latex | 9.6 |
| Propylene glycol | 3.4 |
| Varsol | 3.4 |
| Melamine formaldehyde resin | 3.4 |
| Ammonia | .5 |
| Amine capped sulfonic acid catalyst | 1.0 |
| Thickener | .7 |

At the pad apparatus 21, the printed fabric was finished with a silicone-containing finish and with a non-silicone control, as follows:

| | Silicone Finish | Control |
|---|---|---|
| DMDHEU | 6% | 6% |
| buffered $MgCl_2$ catalyst | 1.5% | 1.5% |
| ceranine HCA | — | 2.5% |
| Silicone 100 (Silicone/polyethylene) | 2.5% | — |
| wetting agent | 0.1% | 0.1% |

The fabrics were dried in a tenter 22 at about 220°-250° F. at 100 yards per minute, leaving approximately 5 percent moisture in the fabric. The fabrics were batched, and later calendered and cured on a Schreiner calender 24 at a surface temperature of 400° F. and a roll pressure of 1840 psi. The fabrics were then tested using standard test methods.

The silicone finished fabric exhibited more shine, and the shine had a greater fastness to home laundering than the non-silicone control. The silicone finished fabric also had a more soft and silky handle and a brighter print appearance than the control, and had less print pickoff during calendering.

In a further aspect of the present invention novel styling effects and significantly enhanced washfastness may be achieved by incorporating a silicone polymer in the printing paste, and finishing either with a conventional non-silicone containing finishing composition or with a silicone-containing finishing composition of the type described earlier. Hot calendering will impart a higher glaze to the area printed with the silicone based print paste than the remainder of the fabric not having the silicone finish. The following examples illustrate this aspect of the present invention.

EXAMPLE 3

A light blue piece-dyed polyester/cotton blend woven fabric was printed with a white opaque printing paste formulation as follows:

| | Percent |
|---|---|
| Titanium dioxide dispersion | 58.1 |
| Varsol | 3.1 |
| Hycar 2679 (acrylic latex) | 15.6 |
| Aluminum silicate dispersion | 13.3 |
| Resin MW | 4.7 |
| Ammonium hydroxide | .8 |
| Amine capped sulfonic acid catalyst | .9 |
| GE 2162 emulsion of polydimethyl siloxane fluid | 2.0 |
| Concentrate T (thickener) | 1.5 |

Additional colored pigments may be added to the above formula depending on color desired. The printing paste was dried and the fabric was then treated with a silicone containing finishing composition and calendered as in Example 1. The fabric exhibited an overall glossy chintz appearance with excellent print coverage and opacity in the printed areas, characterized by an absence of pinholing or pick-off. The fabric was subjected to a standard washfastness test and compared to a similarly processed control sample having the same opaque print paste formulation without silicone polymer. The silicone containing print formulation showed excellent washfastness, whereas in the control sample, the printed pattern was nearly washed away.

EXAMPLE 4

A fabric is printed as in Example 3 with an opaque print formula as follows:

| | Percent |
|---|---|
| Titaninum dioxide dispersion | 58.1 |
| Varsol | 3.1 |
| Hycar 2679 (acrylic latex) | 15.5 |
| Aluminum silicate dispersion | 13.3 |
| Resin MW | 4.7 |
| Ammonium hydroxide | .8 |
| Amine capped sulfonic acid catalyst | .9 |
| Solusoft 115 (silicone/polyethylene blend | 2.0 |
| Concentrate T (thickener) | 1.5 |

Additional colored pigments may be added to the above formula depending on color desired. The printing paste is dried and the fabric is treated as in Example 3.

EXAMPLE 5

A polyester/cotton blend woven fabric is printed with a conventional type of non-opaque print paste to which silicone polymers have been added to enhance gloss and reduce pick-off. The print paste has the following formulation:

| | Percent |
|---|---|
| Print Clear (3% emulsion of Concentrate T) | 85.0 |
| Print Binder (Polybinder 359) | 12.0 |
| Melamine Resin (Uniprint Bonder) | 1.0 |
| GE 2162 emulsion of polydimethyl siloxane fluid | 2.0 |

Additional colored pigments would be added to the above mix depending on the color desired. The print paste is dried and cured in the conventional manner and thereafter subjected to calendering, resulting in a fabric with a glossy appearance in the printed areas.

In the drawings and specification, there have been set forth preferred embodiments of the invention, and although specific terms are employed, they are used in a generic and descriptive sense only and not for purposes of limitation.

That which is claimed is:

1. A chintz fabric formed of textile yarns and characterized by exhibiting a glossy smooth appearance and having enhanced hand, drapability and durability, said fabric having a cured coating of a silicone polymer forming a thin film at the surface of the fabric and encapsulating the fibers present at the surface of the yarns while also penetrating into the yarns to durably retain the cured silicone polymer coating on the fabric, and said thin film of cured silicone polymer also serving to at least partially fill the interstices between the yarns of the fabric and to form a smooth overall surface to the fabric, imparting a glossy chintz appearance thereto.

2. A fabric according to claim 1 wherein outermost portions of the yarns at the surface of the fabric have a flattened configuration, and wherein the presence of the cured silicone polymer in said yarns serves to assist in retaining said flattened surface configuration.

3. A fabric according to claim 1 wherein said curved flexible coating comprises a blend of said silicone polymer with a cross-linking agent.

4. A fabric according to claim 3 wherein said cross-linking agent comprises a durable press finishing agent.

5. A fabric according to claim 1 wherein said yarns are formed at least partially of cellulosic fibers and said cured silicone polymer is crosslinked with the cellulosic fibers.

6. A fabric according to claim 1 wherein said yarns are dyed.

7. A fabric according to claim 1 wherein said yarns are printed with resin bonded pigments.

8. A printed chintz fabric formed of textile yarns and characterized by exhibiting a glossy smooth appearance and having enhanced hand, drapability and durability, said fabric having printed areas at predetermined locations thereon, said printed areas comprising a binder and at least one colorant of a predetermined color adhered to the yarns by said binder, and a cured coating of a silicone polymer overlying the surface of the fabric and the printed areas thereon and forming a film around the fibers present at the surface of the fabric and imparting an overall glossy smooth chintz appearance to the surface of the fabric.

9. A printed fabric according to claim 8 wherein outermost portions of the yarns at the surface of the fabric have a flattened configuration and wherein said cured silicone polymer is crosslinked with the fibers of said yarns for retaining said flattened configuration.

10. A printed fabric according to claim 8 wherein the binder in said printed fabric also includes a silicone polymer.

11. A printed fabric according to claim 8 wherein the yarns of the fabric are dyed a predetermined color and the printed areas formed by said binder and colorant are relatively transparent and allow the color of the underlying yarns to show through.

12. A printed fabric according to claim 8 wherein the yarns of the fabric are dyed a predetermined color and the printed areas formed by said binder and colorant are substantially opaque such that the printed area is substantially unaffected by the color of the underlying yarns.

13. A printed chintz fabric formed of textile yarns and characterized by exhibiting a glossy smooth appearance and having enhanced hand, drapability and durability, said fabric having printed areas at predetermined locations thereon, said printed areas comprising a cured binder and at least one pigment of a predetermined color adhered to the textile yarns by said binder, and a cured substantially transparent coating comprised of a silicone polymer and a cross-linking agent overlying the surface of the fabric and the printed areas thereon and imparting a glossy smooth chintz appearance to the fabric.

14. A printed chintz fabric according to claim 13 wherein said cross-linking agent comprises a durable press resin.

15. A printed fabric formed of textile yarns and having printed areas at predetermined locations thereon, said printed areas comprising a binder and at least one pigment of a predetermined color adhered to the textile strand by said binder, and said binder comprising a cured silicone polymer imparting enhanced washfastness to the printed areas.

16. A printed chintz fabric formed of textile yarns of a predetermined color and characterized by exhibiting a glossy smooth appearance with enhanced hand, drapability and durability, selected areas of said fabric having printed pattern areas of predetermined color contrasting with the color of said yarns, said printed areas being substantially opaque and thus unaffected by the color of said yarns, and said pattern areas comprising an opaque coating covering the exposed surfaces of the yarns and bonded thereto and hiding the underlying color of the yarns, said opaque coating comprising an opacifying pigment providing opacity in said coating and a cured polymer binder affixed to said yarns and bonding said opacifying pigment to the yarns, and a cured substantially transparent coating comprised of a silicone polymer and a durable press finishing agent overlying the surface of the fabric and said printed pattern areas thereon and imparting a glossy smooth chintz appearance to the fabric together with enhanced fabric hand and drapability.

17. A method for finishing a textile fabric to impart a glossy smooth chintz appearance with enhanced hand, drapability and durability, said method comprising applying to the fabric a curable finishing composition comprising a silicone polymer and a curing catalyst, drying the fabric to a moisture content of about 1 to 25 percent, but without effecting substantial curing of the finishing composition, and calendering the fabric with a heated roll to impart a smooth glossy chintz appearance to the fabric while simultaneously curing the silicone-containing finishing composition on the fabric.

18. A method according to claim 17 wherein said step of calendering the fabric with a heated roll is performed with sufficient pressure to effect flattening of the yarns forming the fabric, and wherein the curing of the finishing composition during calendering serves to retain the yarns in the flattened condition.

19. A method according to claim 17 wherein said heated roll has a surface temperature of from 175° to 600° F.

20. A method according to claim 17 including the additional step of heating the fabric following said calendering step to ensure complete curing of the finishing composition.

21. A method according to claim 17 wherein said finishing composition also includes a curable resin.

22. A method according to claim 21 wherein said finishing composition comprises 0.1–25 percent of said silicone, 2–40 percent of said curable resin, 0.1–10 percent of said catalyst, and up to 10 percent of an added surfactant.

23. A method of producing a printed fabric having a glossy chintz appearance with enhanced hand, drapability and durability, said method comprising printing predetermined areas of the fabric, impregnating the printed fabric with a curable finishing composition comprising a silicone polymer, a cross-linking agent and a catalyst, drying the fabric to a moisture content of about 1 to 25 percent, but without effecting substantial curing of the finishing composition, and calendering the fabric with a heated roll to impart a smooth glossy chintz appearance to the fabric while simultaneously curing the finishing composition on the fabric.

24. A method according to claim 23 wherein said step of printing predetermined areas of the fabric comprises applying to said predetermined areas of the fabric a printing paste comprised of a binder and at least one colorant of predetermined color and curing the printing paste to thereby bind the colorant to the fabric.

25. A method according to claim 24 wherein said colorant comprises pigment and said binder comprises a heat curable resin binder, and wherein said step of curing the printing paste is accomplished by heating.

26. A method according to claim 24 wherein said printing paste additionally includes a silicone polymer.

27. A method for producing a printed fabric comprising printing predetermined areas of the fabric with a printing paste comprising at least one pigment of predetermined color, a curable binder, a silicone polymer, and a catalyst, drying the printing paste, and calendering the fabric with a heated roll to effect curing of the silicone polymer.

28. A method according to claim 27 including the further step, performed prior to said calendering step, of applying to the fabric a curable finishing composition comprising a silicone polymer and a catalyst, and wherein said calendering step also serves for curing said finishing composition and imparting an overall shiny chintz appearance to the fabric.

29. A fabric produced by the method of claim 17.

30. A fabric produced by the method of claim 23.

31. A fabric produced by the method of claim 27.

* * * * *